US009455100B2

(12) United States Patent
Inose et al.

(10) Patent No.: US 9,455,100 B2
(45) Date of Patent: Sep. 27, 2016

(54) SWITCH

(71) Applicant: HONDA MOTOR CO., LTD., Minato-Ku, Tokyo (JP)

(72) Inventors: Koji Inose, Wako (JP); Yusuke Takaishi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/646,405

(22) PCT Filed: Sep. 13, 2013

(86) PCT No.: PCT/JP2013/074855

§ 371 (c)(1),
(2) Date: May 21, 2015

(87) PCT Pub. No.: WO2014/083915

PCT Pub. Date: Jun. 5, 2014

(65) Prior Publication Data

US 2015/0287555 A1 Oct. 8, 2015

(30) Foreign Application Priority Data

Nov. 28, 2012 (JP) ..... 2012-259727

(51) Int. Cl.
*H01H 9/02* (2006.01)
*H01H 25/00* (2006.01)
(Continued)

(52) U.S. Cl.
CPC ..... *H01H 9/02* (2013.01); *H01H 25/008* (2013.01); *H01H 25/06* (2013.01); *H01H 1/365* (2013.01); *H01H 3/50* (2013.01); *H01H 2009/068* (2013.01); *H01H 2221/016* (2013.01)

(58) Field of Classification Search
CPC .. H01H 9/02; H01H 25/06; H01H 2221/016; H01H 1/365; H01H 25/008; H01H 2009/068; H01H 3/50
USPC ..... 200/4, 6 A
See application file for complete search history.

(56) References Cited

U.S. PATENT DOCUMENTS 3,612,785 A 10/1971 Baldwin
5,623,134 A * 4/1997 Hayakawa ..... H01H 3/20 200/16 C (Continued)

FOREIGN PATENT DOCUMENTS

EP 1 764 815 A2 3/2007
EP 1 862 384 A2 12/2007

(Continued)

OTHER PUBLICATIONS

International Application Search Report (PCT/ISA/210) from PCT/JP2013/074855 with a mailing date of Dec. 3, 2013.

(Continued)

*Primary Examiner* — Edwin A. Leon
(74) *Attorney, Agent, or Firm* — Carrier Blackman & Associates, P.C.; Joseph P. Carrier; William D. Blackman

(57) ABSTRACT

A switch, which returns a switch lever to a rotation neutral position by a force for pressing a steel ball against left and right slopes, includes a guide plate portion that is provided in a switch case, does not come into contact with the switch lever during a rotational operation of the switch lever and a pushing operation at the rotation neutral position, and comes into contact with the switch lever during the pushing operation in a state in which the switch lever is tilted from the rotation neutral position. The guide plate portion forms a second slope that is disposed so as to return the switch lever, which comes into contact with the second slope, to the rotation neutral position.

6 Claims, 9 Drawing Sheets

(51) Int. Cl.

| | |
|---|---|
| ***H01H 25/06*** | (2006.01) |
| *H01H 3/50* | (2006.01) |
| *H01H 9/06* | (2006.01) |
| *H01H 1/36* | (2006.01) |

(56) References Cited

U.S. PATENT DOCUMENTS

| | | | | |
|---|---|---|---|---|
| 6,160,225 | A * | 12/2000 | Isikawa | H01H 25/04 200/4 |
| 6,266,046 | B1 * | 7/2001 | Arita | G05G 9/047 345/156 |
| 6,787,716 | B1 * | 9/2004 | Menche | H01H 11/0006 200/5 R |
| 8,921,719 | B2 * | 12/2014 | Suzuki | G05G 9/047 200/4 |
| 8,957,331 | B2 * | 2/2015 | Matsumoto | H01H 25/041 200/4 |
| 9,052,736 | B2 * | 6/2015 | Kreider | B60K 37/06 |

FOREIGN PATENT DOCUMENTS

| | | | |
|---|---|---|---|
| JP | 07-192581 | A | 7/1995 |
| JP | 07-245042 | A | 9/1995 |
| JP | 07-254328 | A | 10/1995 |
| JP | 2002-373559 | A | 12/2002 |
| JP | 2011-181337 | A | 9/2011 |

OTHER PUBLICATIONS

Office Action issued in the corresponding Chinese patent application 201380061203.5, with a mailing date of May 5, 2016, and the English translation thereof.

European Search Report issued in corresponding EP Patent Application 13858658.1 with a mailing date of Jul. 14, 2016.

* cited by examiner

SWITCH

TECHNICAL FIELD

The present invention relates to a switch that allows a rotational operation of a switch lever and a pushing operation at a rotation neutral position to be performed.

Priority is claimed on Japanese Patent Application No. 2012-259727, filed Nov. 28, 2012, the content of which is incorporated herein by reference.

BACKGROUND ART

A switch, which allows a rotational operation of the switch lever to the left and right and a pushing operation at an intermediate position between the leftward rotation and the rightward rotation of the switch lever, has been known in the past (for example, see Patent Document 1).

CITATION LIST

Patent Literature

[Patent Document 1] Japanese Unexamined Patent Application, First Publication No. H7-254328

SUMMARY OF INVENTION

Technical Problem

The switch includes a switch lever that is supported so as to be rotatable in the switch case and allow a pushing operation at a rotation neutral position, and a lever neutral position restoration mechanism that includes a V-shaped slope in the switch case and a steel ball held at a front end portion of the switch lever so as to be biased and biases the switch lever to the rotation neutral position.

In the above-mentioned technique, when the switch lever is pushed while being tilted from a rotation neutral position by a wrong operation, if the tilt of the switch lever is small to some extent, the pushing operation can be completed while the switch lever is returned to the rotation neutral position by the action of the lever neutral position restoration mechanism. However, since it is difficult to ensure an angle between the V-shaped slope and the pushing direction of the switch lever if the tilt of the switch lever is equal to or larger than a certain value, a pushing operation at a correct rotation neutral position cannot be performed.

Further, when an angle of the slope of the switch case is changed or a biasing force of the steel ball is increased so that the switch lever easily returns to the rotation neutral position even though the switch lever is pushed while being tilted from a rotation neutral position, an operational feeling of the switch lever is greatly changed.

That is, it was difficult to satisfy both maintaining a good operational feeling of the switch lever and reliably performing the operation for pushing the switch lever.

An object of an aspect of the invention is to reliably perform an operation for pushing a switch lever while maintaining the good operational feeling of the switch lever in a switch that allows a rotational operation of a switch lever and a pushing operation at a rotation neutral position.

Solution to Problem

The invention employs the following aspects as means for solving the problem.

(1) A switch of an aspect according to the invention includes a switch case, a switch lever that is supported by the switch case so as to allow a rotational operation and a pushing operation, a first guide portion that is provided on a side opposite to an operation portion of the switch lever in the switch case and forms a V-shaped slope, and a movable element that is held at an end portion of the switch lever close to the first guide portion and is biased to the slope. A lever neutral position restoration mechanism, which includes the movable element and the first guide portion and returns the switch lever to a rotation neutral position by a force for pressing the movable element against the slope, is formed. The switch includes a second guide portion that is provided in the switch case, does not come into contact with the switch lever during the rotational operation of the switch lever and the pushing operation at the rotation neutral position, and comes into contact with the switch lever during the pushing operation in a state in which the switch lever is tilted from the rotation neutral position. The second guide portion forms a second slope that is disposed so as to return the switch lever, which comes into contact with the second slope, to the rotation neutral position.

(2) In the aspect of (1), an inclination angle between the second slope and a center line of the switch case, which is parallel to a pushing direction of the switch lever at the rotation neutral position, may be smaller than an inclination angle between the slope and the center line.

(3) In the aspect of (1) or (2), the second slope of the second guide portion may be provided so as to be offset from the slope of the first guide portion in a rotation axis direction of the switch lever.

(4) In any one aspect of (1) to (3), a longitudinal intermediate portion of the switch lever may be supported by a rotating shaft, a holding portion, which holds the movable element, may be provided at the end portion of the switch lever close to the first guide portion, and a tip of the holding portion may come into contact with the second slope of the second guide portion.

(5) In any one aspect of (1) to (4), the first guide portion may be provided separately from the switch case, and the second guide portion may be provided integrally with the first guide portion.

(6) The switch of any one aspect of (1) to (5) may further include a holder that holds a movable contact coming into contact with or being separated from stationary contacts provided in the switch case, is supported so as to be rotatable together with the switch lever from a contact-neutral position where a flow of current between the contacts is cut off in the switch case, and is rotated by the rotational operation of the switch lever. The holder may be disposed so as to be offset from the switch lever to one side in a rotation axis direction of the switch lever, and the second guide portion may be disposed so as to be offset from the slope of the first guide portion to the other side in the rotation axis direction of the switch lever.

Advantageous Effects of Invention

According to the aspect of (1), the second slope, which comes into contact with the switch lever only when the switch lever is pushed in a state in which the switch lever is tilted from the rotation neutral position and guides the switch lever to the rotation neutral position, is provided separately from the slope of the first guide portion. Accordingly, it is possible to reliably perform a pushing operation without affecting a force, which is generated by the slope of the first guide portion and returns the switch lever to the rotation neutral position, and the like, even when the switch lever is obliquely pushed. That is, it is possible to reliably perform an operation for pushing the switch lever after maintaining the good operational feeling of the switch lever.

In the case of (2), it is possible to efficiently use a pushing force, which is applied to the switch lever, as a force that returns the switch lever to the rotation neutral position, in comparison with a case in which an inclination angle between the second slope and the center line of the switch case is large.

In the case of (3), it is possible to simply install the second slope of the second guide portion while avoiding the movable element, which is held by the switch lever, in the rotation axis direction.

In the case of (4), a tip of the holding portion present at a position distant from the rotation axis of the switch lever comes into contact with the second slope of the second guide portion. Accordingly, it is possible to reasonably return the switch lever to the rotation neutral position by a force that is generated when the switch lever comes into contact with the second slope.

In the case of (5), the first guide portion is provided separately from the switch case. Accordingly, it is possible to ensure the same operability by changing only the guide portion when the shape or the like of the switch lever is changed. Therefore, it is possible to easily change the switch lever. Since the second guide portion is provided integrally with the first guide portion, it is possible to simultaneously change portions corresponding to the change of the switch lever (the first and second guide portions). Accordingly, it is possible to easily change the switch lever and to suppress an increase in the number of components.

In the case of (6), the holder and the second guide portion are disposed so as to be distributed to one side and the other side in the rotation axis direction of the switch lever. Accordingly, it is possible to increase a degree of freedom in the disposition of switch components by suppressing interference between the second guide portion and the holder.

DESCRIPTION OF EMBODIMENTS

Figure 1:
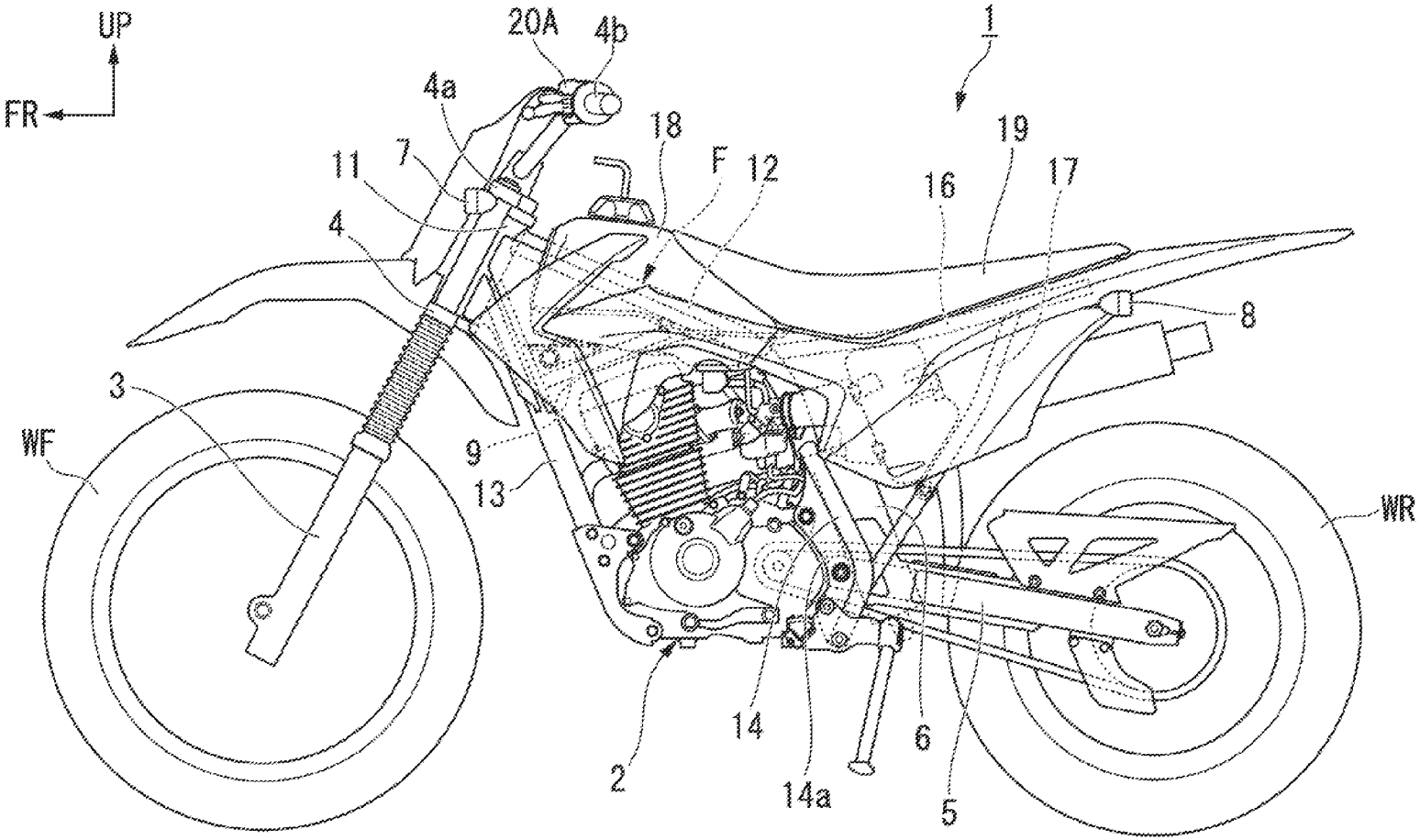
FIG. 1 is a left side view of a motorcycle according to an embodiment of the invention.

An embodiment of the invention will be described below with reference to the drawings. In addition, the orientations, such as the front, the rear, the left, and the right, in the following description are the same as the orientations of a vehicle to be described below if special description is not made. Further, an arrow FR indicating the front side of the vehicle, an arrow LH indicating the left side of the vehicle, and an arrow UP indicating the upper side of the vehicle are shown at proper positions in the drawings that are used in the following description.

A motorcycle 1 shown in FIG. 1 is an off-road vehicle of which a rear wheel WR is driven by an engine (internal combustion engine) 2. A vehicle body frame F of the motorcycle 1 includes a head pipe 11 that is disposed at a front end portion, a main frame 12 that extends rearward and downward from an upper portion of the head pipe 11, a down pipe 13 that extends rearward and downward from a lower portion of the head pipe 11 at an angle larger than an angle of the main frame 12, a gusset pipe 9 that is provided between an intermediate portion of the down pipe 13 and an intermediate portion of the main frame 12, a pair of (left and right) center pipes 14 that are branched to the left and right from a lower end portion of a downward curved portion of a rear portion of the main frame 12 and extend rearward and downward, a pair of (left and right) seat rails 16 that are branched to the left and right from the downward curved portion of the rear portion of the main frame 12 and substantially horizontally extend rearward, and a pair of (left and right) support pipes 17 that extend rearward and upward from lower portions of the left and right center pipes 14 and are joined to rear portions of the left and right seat rails 16. The engine 2 is mounted inside the vehicle body frame F.

Left and right front forks 3 are supported through a steering stem 4 by the head pipe 11. A front wheel WF of the motorcycle 1 is supported at lower end portions of the left and right front forks 3.

A steering bar handle 4*b* is mounted on a top bridge 4*a* of the steering stem 4. Left and right front blinkers 7 are mounted near a side portion of the top bridge 4*a*.

Front end portions of swing arms 5 are supported by left and right pivot plates 14*a* that are fixed to front portions of the left and right center pipes 14. The rear wheel WR of the motorcycle 1 is supported by rear end portions of the swing arms 5. Lower end portions of rear cushions 6, which extend vertically near lower portions of front portions of the swing arms 5, are connected to the lower portions of front portions of the swing arms 5.

A fuel tank 18, which stores fuel for the engine 2, is disposed above the engine 2. A seat 19, which is supported on the left and right seat rails 16 and on which a rider is seated, is disposed in the rear of the fuel tank 18. A pair of (left and right) rear blinkers 8 are mounted near a rear end portion of the seat 19.

A switch box 20A, which includes a blinker switch 20 used to operate the left and right blinkers, is disposed, for example, at a base end portion of a left grip portion of the bar handle 4*b*.

Figure 2:
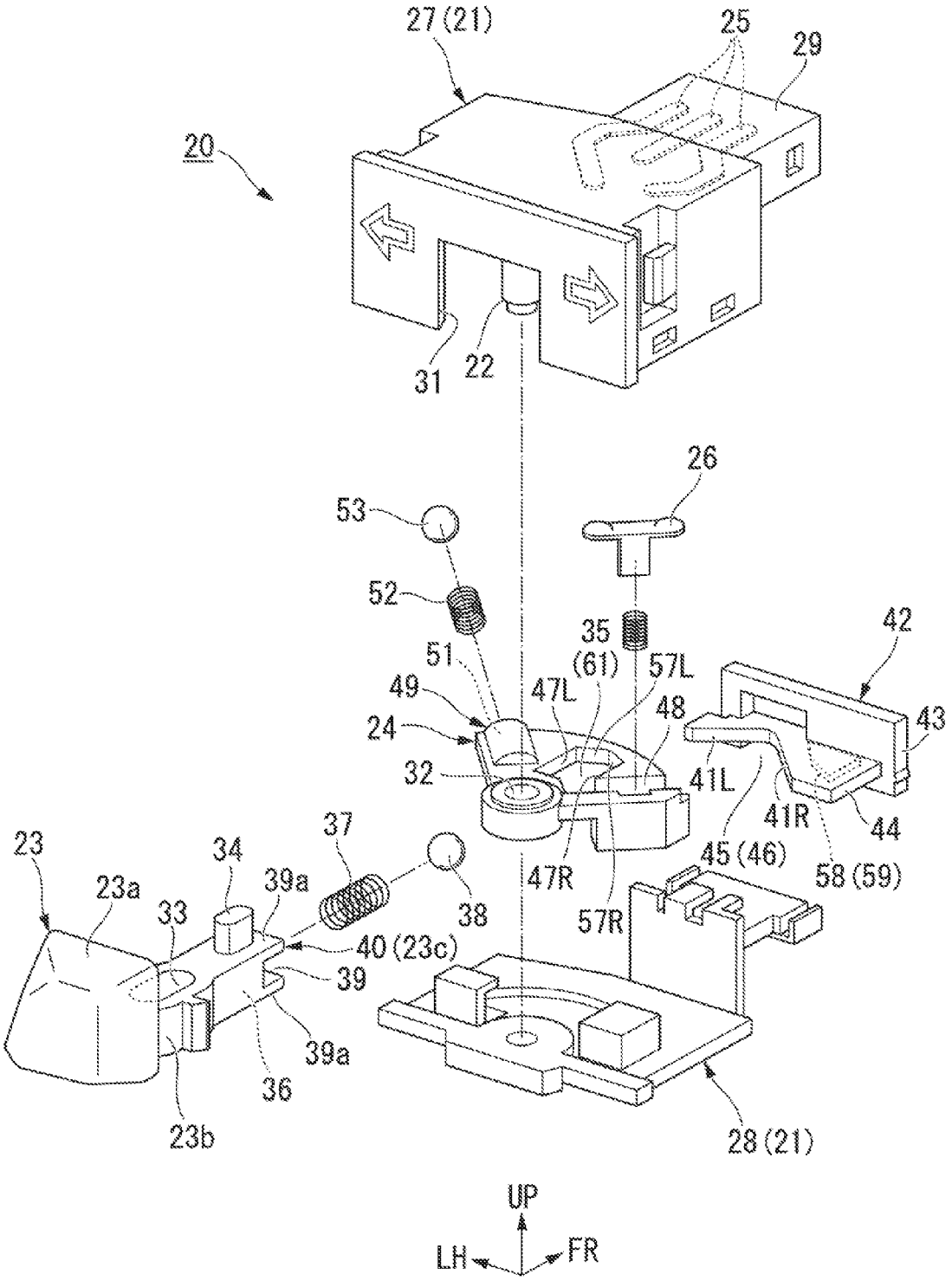
FIG. 2 is an exploded perspective view of a blinker switch of the motorcycle.
Figure 3:
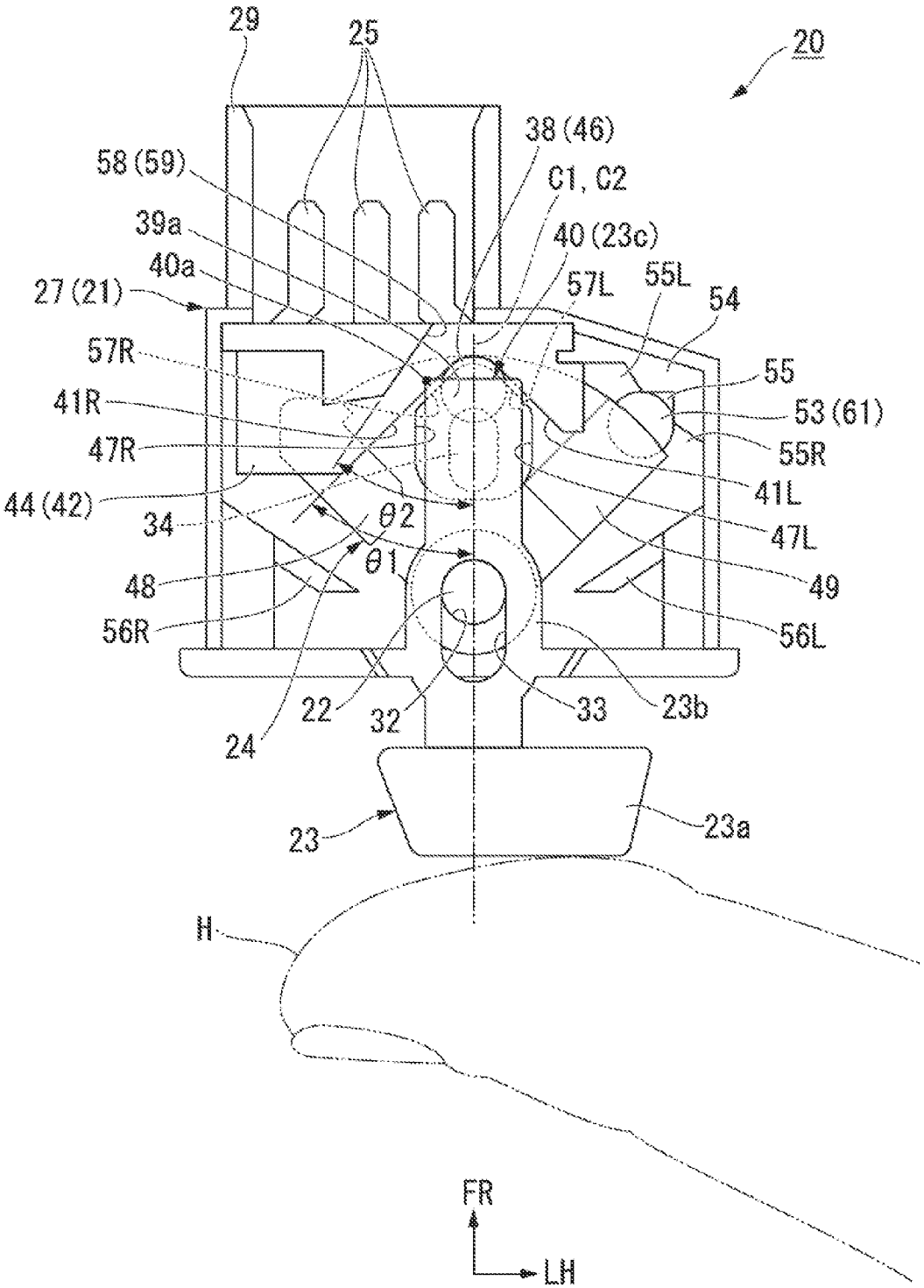
FIG. 3 is a plan view of the blinker switch that is seen from below.

The blinker switch 20 shown in FIGS. 2 and 3 supports a longitudinal intermediate portion 23*b* of a switch lever 23, which extends forward and rearward, by a rotating shaft 22, which extends upward and downward in a switch case 21, so that the intermediate portion 23*b* is rotatable to the left and right. The switch lever 23 allows an operation portion 23*a*, which is formed at a rear end portion of the switch lever 23 protruding to the outside of the switch case 21 (to the rear side, toward a rider), to be rotated (swung) to the left and right by the rider's left hand's finger (particularly, the thumb) H. In addition, for convenience in showing, the blinker switch 20 is seen obliquely from above in FIG. 2 but the blinker switch 20 is seen from below in FIGS. 3 to 9.

The blinker switch 20 rotates a holder 24, which is supported by the rotating shaft 22 so as to be rotatable to the left and right in the switch case 21 likewise, in the same direction as the switch lever 23 by the rightward and leftward rotation of the switch lever 23.

Figure 6:
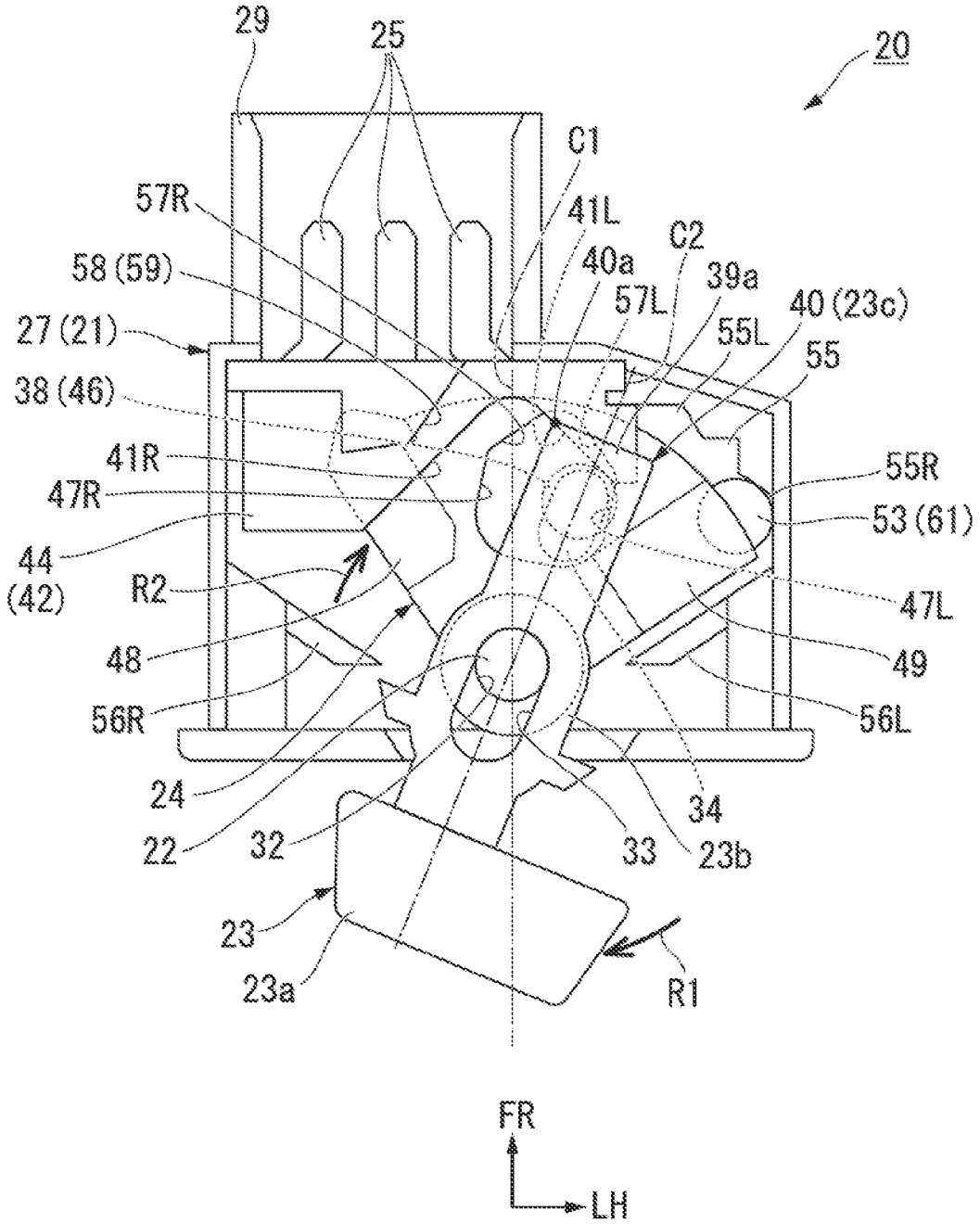
FIG. 6 is a plan view which corresponds to FIG. 3 and in which a rider has operated the blinker switch to a right turn side.

That is, in a plan view of FIG. 3, the holder 24 is also rotated about the rotating shaft 22 in the counterclockwise direction when the switch lever 23 is rotated about the rotating shaft 22 in a counterclockwise direction (see arrows L1 and L2 of FIG. 4), and the holder 24 is also rotated about the rotating shaft 22 in the clockwise direction when the switch lever 23 is rotated about the rotating shaft 22 in a clockwise direction (see arrows R1 and R2 of FIG. 6).

The holder 24 holds a movable contact 26 that appropriately comes into contact with or is appropriately separated from three stationary contacts 25 fixed in the switch case 21. The movable contact 26 switches a blinker circuit of the motorcycle 1 to any one of a blinker turn-off state, a left blinker flickering state, and a right blinker flickering state by appropriately coming into contact with or being appropriately separated from each stationary contact 25 according to the rotation of the holder 24.

If special description is not made below, it is regarded that the switch lever 23 is present at an intermediate position (hereinafter, referred to as a rotation neutral position) between the leftward rotation and the rightward rotation and the holder 24 is present at an intermediate position (hereinafter, referred to as a contact-neutral position) between the leftward rotation and the rightward rotation.

Referring to FIG. 2, the switch case 21 has a substantially hollow rectangular parallelepiped shape, and includes a box-shaped case body 27 that is opened downward and a cover member 28 that covers a lower opening of the case body 27. A coupler 29, which protrudes forward, is formed integrally with a front wall portion of the case body 27. A lower wall portion of the coupler 29 is formed integrally with a front end portion of the cover member 28. A notch 31, which allows the switch lever 23 to be disposed across the inside and outside of the case, is formed at a rear wall portion of the case body 27. Each of the case body 27 and the cover member 28 is formed of an integrated resin molding.

A rotating shaft 22, which is erected downward, is formed integrally with an upper wall portion of the case body 27. The holder 24 and the switch lever 23 are supported in this order from above by the rotating shaft 22.

The holder 24 has the shape of a fan-shaped plate that spreads out forward in plan view (when seen in a vertical direction), and includes a support hole 32 that is formed a base end portion (rear end portion) of the holder and vertically passes through the base end portion of the holder. The rotating shaft 22 is inserted into the support hole 32. The holder 24 is formed of an integrated resin molding.

The switch lever 23 has a rectangular cross-sectional shape and extends forward and rearward, and includes a through hole 33 that is formed at the longitudinal intermediate portion 23*b* and vertically passes through the longitudinal intermediate portion 23*b*. The through hole 33 has an elliptical shape that is elongated forward and rearward in plan view, and the rotating shaft 22 is inserted into the through hole 33. Accordingly, the switch lever 23 is supported by the switch case 21 so as to be rotatable to the left and right and movable forward and rearward by a predetermined distance. The switch lever 23 is formed of an integrated resin molding.

An engaging protrusion 34, which protrudes upward, is formed on a front end portion 23*c* of the switch lever 23. The engaging protrusion 34 has an elliptical cross-section elongated forward and rearward and protrudes upward, and is loosely fitted to a home base-shaped (pentagonal) cam hole 35 that is formed at a central portion of the holder 24 in plan view. A bottomed receiving hole 36, which is opened forward, is formed in the front end portion 23*c* of the switch lever 23. A coil spring 37 and a steel ball 38 are received in the receiving hole 36 in this order from the inside (the rear side) of the receiving hole.

Left and right notches 39, which allow both side portions of the front portion of the receiving hole 36 to be laterally opened so that the steel ball 38 is not separated, are formed at both left and right side portions of the front end portion 23*c* of the switch lever 23. Upper and lower plate-like portions 39*a*, which face each other with the left and right notches 39 interposed therebetween in the vertical direction and have a rectangular shape in plan view, are formed at upper and lower portions of the front end portion 23*c* of the switch lever 23. The front end portion 23*c*, at which the receiving hole 36 and the notches 39 are formed, of the switch lever 23 forms a holding portion 40 that holds the steel ball 38 and the coil spring 37.

A guide member 42, which forms left and right slopes 41L and 41R with which the steel ball 38 held in the receiving hole 36 of the switch lever 23 comes into rolling contact, is mounted on the rear surface of the front wall portion of the case body 27 (in the case). The guide member 42 includes a vertical plate portion 43 that is substantially vertically disposed along the front wall portion of the case body 27 and a horizontal plate portion 44 that substantially horizontally extends forward from the lower end portion of the vertical plate portion 43. The guide member 42 is formed of an integrated resin molding.

The guide member 42 is provided close to one side (right side) of a center line (shown by a one-dot chain line C1 of FIG. 3) on which the rotating shaft 22 of the case body 27 is disposed. A notch 45, which is opened rearward in plan view and forms the left and right slopes 41L and 41R disposed in a V shape, is formed at the horizontal plate portion 44. The left and right slopes 41L and 41R, which extend along an inner peripheral edge of the notch 45 so as to have the same thickness as the horizontal plate portion 44, are disposed so as to have the same opening angle that is inclined with respect to the center line C1 in plan view. The left and right slopes 41L and 41R are disposed close to the left side of the guide member 42 so that an intersection of extension lines of the left and right slopes is positioned on the center line of the case body 27.

The left and right slopes 41L and 41R are disposed so as to go inside the inner periphery of the rotation locus of the front end portion 23*c* of the switch lever 23 (which is approximate to the outer peripheral arc of the holder 24) toward the outside of the left and right sides thereof in plan view. The steel ball 38, which is held in the receiving hole 36 of the switch lever 23, is guided by the left and right slopes 41L and 41R and enters the valley of the notch 45 when the switch lever 23 is not operated. At this time, the switch lever 23 is at the rotation neutral position where a center axis C2 of the switch lever 23 is parallel to a front-rear direction, and is held at the rotation neutral position by a spring force of the coil spring 37.

At the rotation neutral position, the center axis C2 of the switch lever 23 overlaps the center line C1 of the case body 27 in plan view. A lever neutral position restoration mechanism 46, which includes the V-shaped left and right slopes 41L and 41R provided in the switch case 21 and the coil spring 37 and the steel ball 38 held at the front end portion 23*c* of the switch lever 23 and biases the switch lever 23 to the rotation neutral position, is formed in the blinker switch 20.

Figure 4:
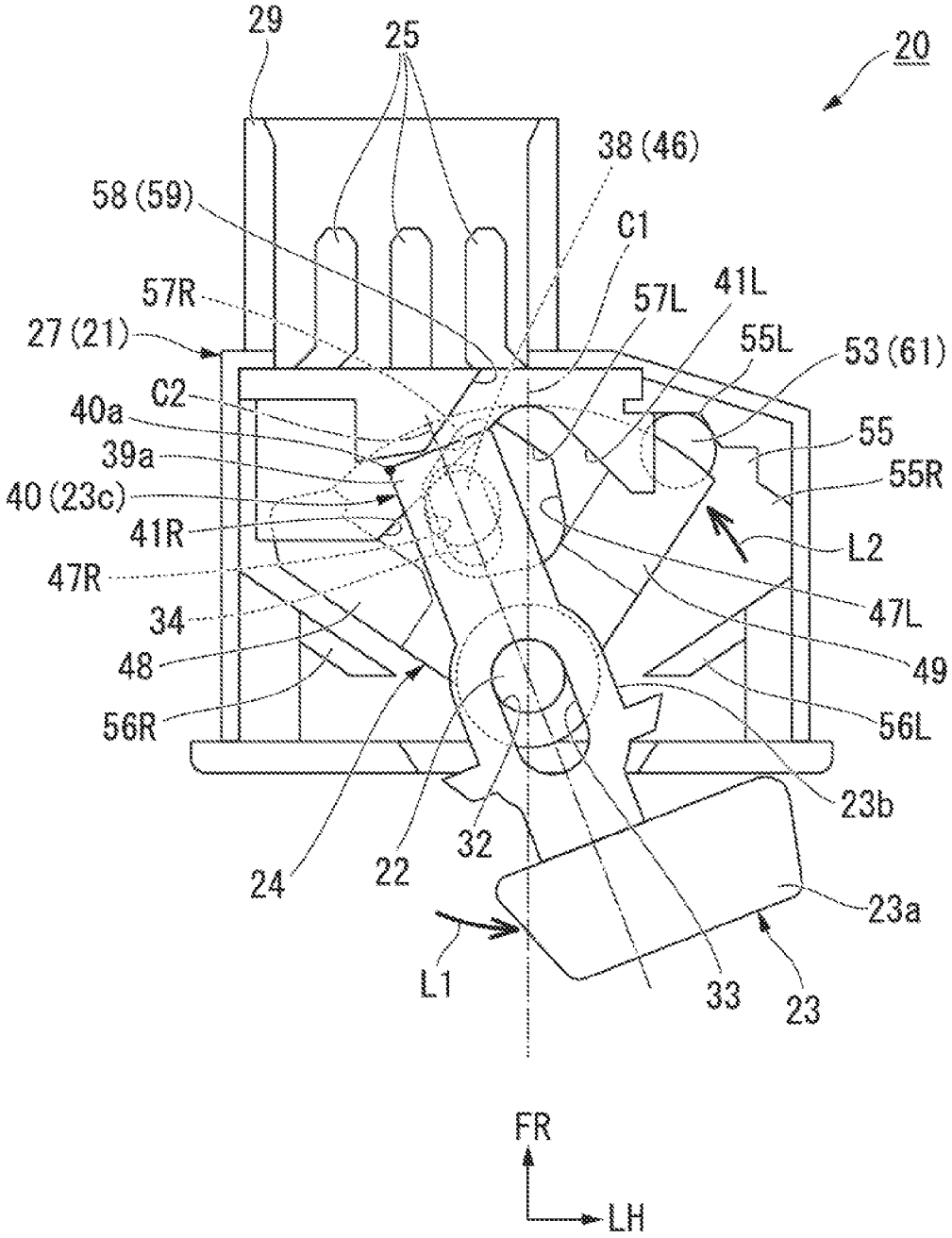
FIG. 4 is a plan view which corresponds to FIG. 3 and in which a rider has operated the blinker switch to a left turn side.

When the switch lever 23 present at the rotation neutral position is rotated to the left and right as shown in FIGS. 4 and 6, the steel ball 38 is inserted into the receiving hole 36 while rolling on the left and right slopes 41L and 41R and generates operation reaction at the switch lever 23 by using the spring force of the coil spring 37. When the switch lever 23 is rotated to the left and right and the steel ball 38 is inserted into the receiving hole 36, the horizontal plate portion 44 is inserted into the notches 39 of the switch lever 23 (between the upper and lower plate-like portions 39*a*) (the upper and lower plate-like portions 39*a* overlap the horizontal plate portion 44).

Figure 5:
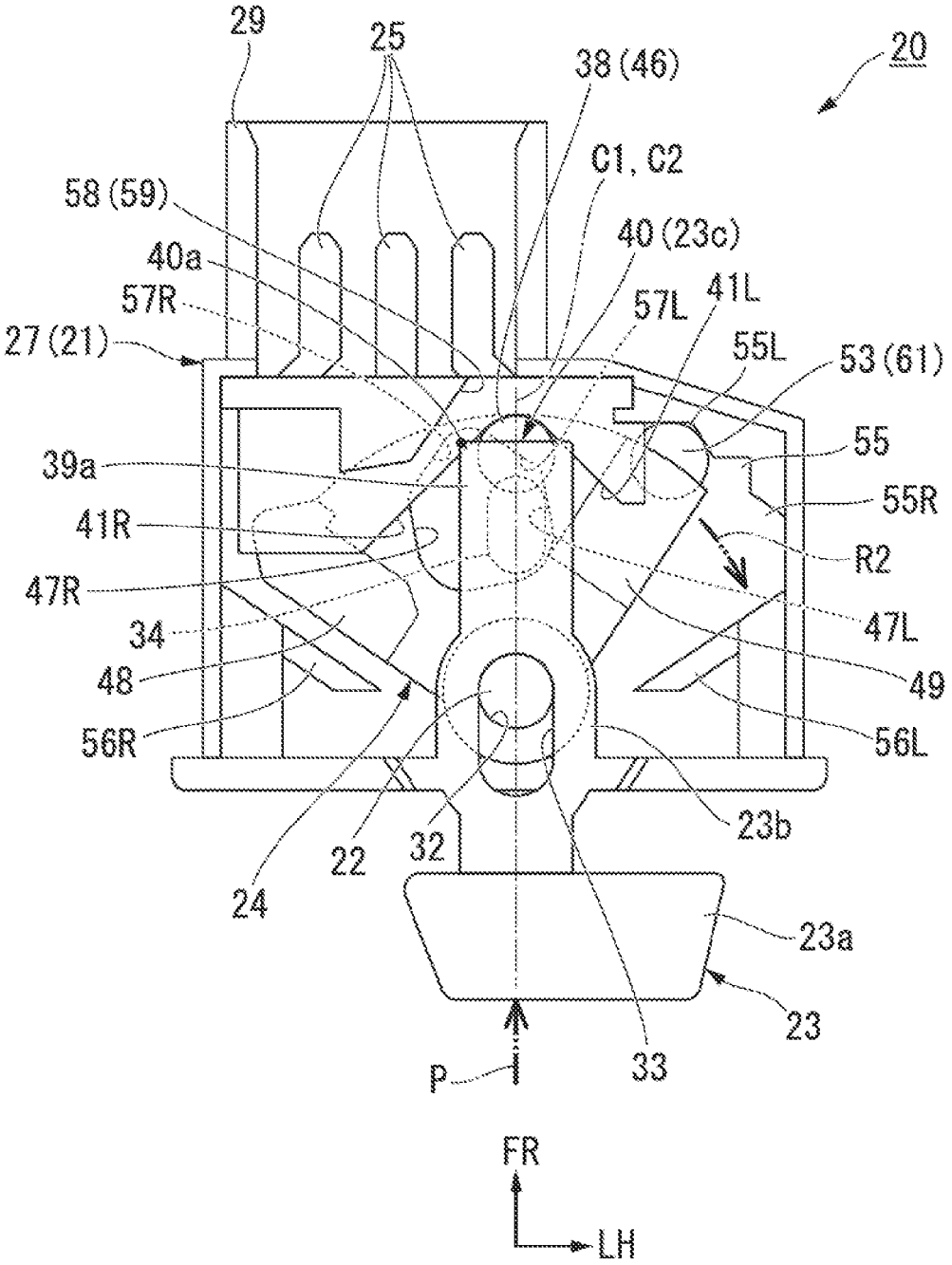
FIG. 5 is a plan view which corresponds to FIG. 3 and in which a rider has cancelled an operation input from FIG. 4.
Figure 7:
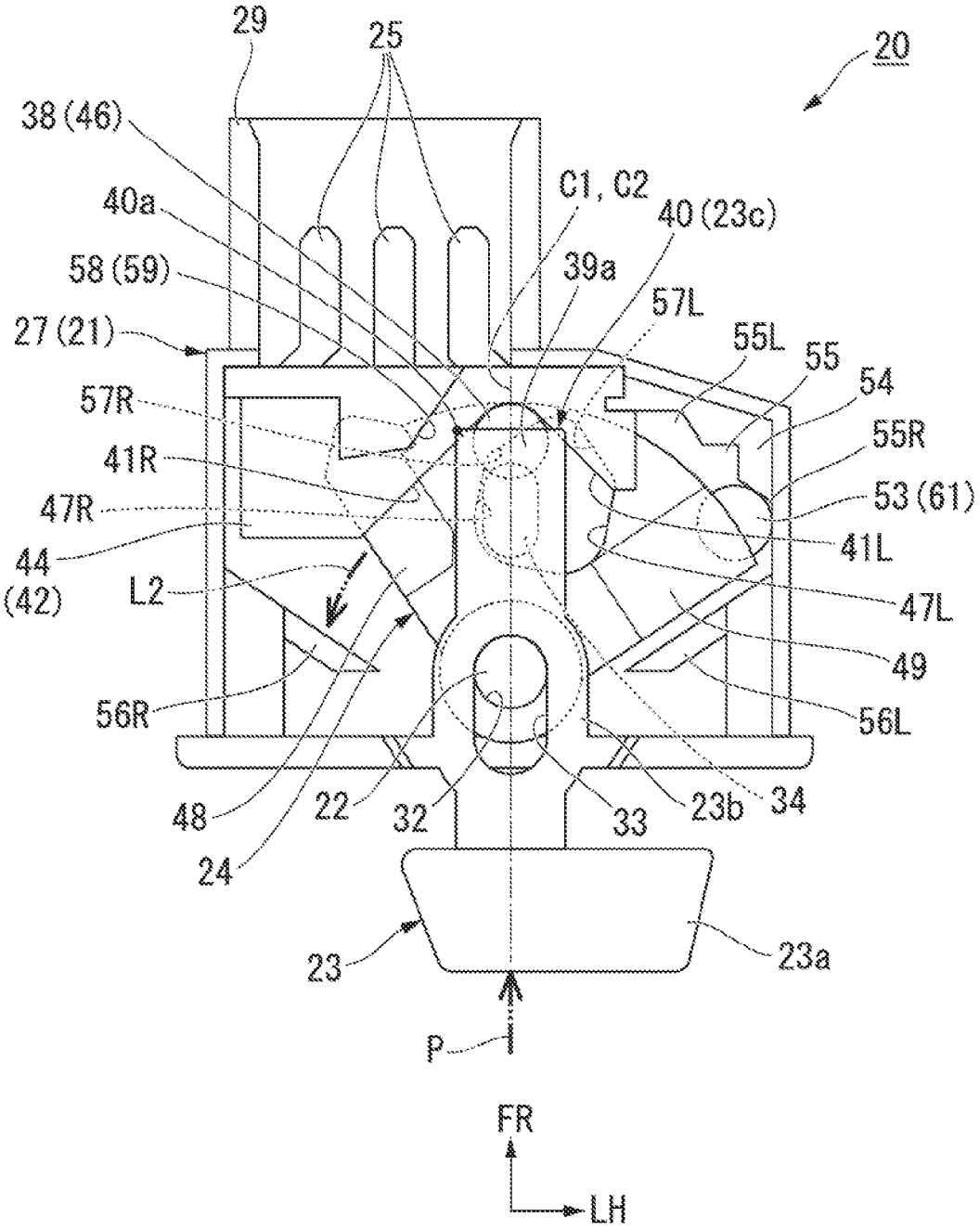
FIG. 7 is a plan view which corresponds to FIG. 3 and in which a rider has cancelled an operation input from FIG. 6.

When an operation input to the switch lever 23 is cancelled after the switch lever 23 is rotated to the left and right, the steel ball 38 is guided to the valley of the notch 45 and the switch lever 23 returns to the rotation neutral position (see FIGS. 5 and 7).

When the switch lever 23 is rotated to the left and right by a predetermined angle, the engaging protrusion 34 comes into contact with the left and right side surfaces 47L and 47R of the inner periphery of the cam hole 35 of the holder 24. After that, the switch lever 23 rotates the holder 24 by the engagement between the engaging protrusion 34 and the cam hole 35.

Referring to FIGS. 2 and 3, a contact mounting portion 48 on which the movable contact 26 is mounted is formed at an outer peripheral portion (an outer portion in a radial direction) of a right side of the fan-shaped holder 24. A cylindrical click holder 49, which is formed along the right side of the fan-shaped holder, is formed at an outer peripheral portion of a left side of the fan-shaped holder 24. A bottomed receiving hole 51, which is opened to the outer periphery of the holder 24, is formed in the click holder 49. A coil spring 52 and a steel ball 53 are received in the receiving hole 51 in this order from the inside of the receiving hole.

A click groove 54 with which the steel ball 53 held in the receiving hole 51 is engaged is formed at a corner portion of the case body 27 that is positioned on the extending direction of the click holder 49. The click groove 54 includes a recess 55 for neutral that is engaged with the steel ball 53 to stop the rotation of the holder 24 when the holder 24 is present at the contact-neutral position, a recess 55L for left turn that is engaged with the steel ball 53 to stop the rotation of the holder 24 when the holder 24 is present at a left-turn position, and a recess 55R for right turn that is engaged with the steel ball 53 to stop the rotation of the holder 24 when the holder 24 is present at a right-turn position.

When the holder 24 receives a rotational operating force equal to or larger than a predetermined value in a state in which the holder 24 is held at any one of the contact-neutral position, the left-turn position, and the right-turn position, the holder 24 moves the steel ball 53 between the recesses of the click groove 54 while inserting the steel ball 53 into the click holder 49 against the biasing force of the coil spring 52. Accordingly, the holder 24 can be switched to any one aspect of the contact-neutral position, the left-turn position, and the right-turn position.

When the holder 24 is present at the contact-neutral position, the blinker circuit is in a non-operation state of the blinker. When the holder 24 is present at the left-turn position, the blinker circuit is in a left blinker operating (flickering) state. When the holder 24 is present at the right-turn position, the blinker circuit is in a right blinker operating state. Left and right rotation stoppers 56L and 56R, which limit the leftward rotation and rightward rotation of the holder 24, are provided at both rear corner portions of the case body 27.

When a hand is taken off the switch lever 23 (an operation input is cancelled) after the holder 24 is rotated to any one of the left-turn position and the right-turn position by the rotational operation of the switch lever 23, as shown in FIGS. 5 and 7, only the switch lever 23 is returned to the rotation neutral position by the lever neutral position restoration mechanism 46 while the holder 24 is held at any one of the right-turn position and the left-turn position. Since the engaging protrusion 34 of the switch lever 23 merely moves within the cam hole 35 of the holder 24 at this time, the switch lever 23 does not rotate the holder 24.

In a state in which only the switch lever 23 returns to the rotation neutral position, the front side in a direction parallel to the major axis of the through hole 33 of the switch lever 23 (a direction parallel to the center line C1 and the center axis C2) corresponds to the pushing direction of the switch lever 23 (a direction indicated by an arrow P in FIGS. 5 and 7). Any one of left and right slopes 57L and 57R, which are formed at a front portion of the cam hole 35 of the holder 24 present at any one of the left-turn position and the right-turn position, is disposed on a direction of the engaging protrusion 34 of the switch lever 23 that is indicated by the arrow P.

Referring to FIG. 5, when the holder 24 is present at the left-turn position, the left slope 57L of the cam hole 35 is positioned on the direction of the engaging protrusion 34 that is indicated by the arrow P. The left slope 57L is inclined so as to be positioned rearward as it goes leftward. In this state, when the operation portion 23*a* of the switch lever 23 is pushed in the direction of the arrow P as a cancel operation for the blinker, the engaging protrusion 34 comes into sliding contact with the left slope 57L while pressing the left slope 57L of the cam hole 35 forward and generates a force that returns the holder 24 to the contact-neutral position. When this force exceeds a holding force generated by the engagement between the steel ball 53 and the click groove 54, the holder 24 is rotated in the direction of the arrow P so as to return to the contact-neutral position and the blinker circuit is switched to the non-operation state of the blinker (the blinker is cancelled).

Referring to FIG. 7, when the holder 24 is present at the right-turn position, the right slope 57R of the cam hole 35 is positioned on the direction of the engaging protrusion 34 that is indicated by the arrow P. The right slope 57R is inclined so that a portion, which is closer to the right side, of the right slope 57R is positioned on the further rear side. In this state, when the operation portion 23*a* of the switch lever 23 is pushed in the direction of the arrow P, the engaging protrusion 34 comes into sliding contact with the right slope 57R while pressing the right slope 57R of the cam hole 35 forward and generates a force that returns the holder 24 to the contact-neutral position. When this force exceeds a holding force generated by the engagement between the steel ball 53 and the click groove 54, the holder 24 is rotated in a direction of an arrow L2 so as to return to the contact-neutral position and the blinker circuit is switched to the non-operation state of the blinker.

In the blinker switch 20, a holder neutral position restoration mechanism 61 includes the left and right slopes 57L and 57R that are formed at the holder 24 so as to be disposed in a V shape and the engaging protrusion 34 that is formed at the switch lever 23, is engaged with the holder 24, and can rotate the holder 24. The holder neutral position restoration mechanism 61 returns the holder 24, which is stopped at any one of the left-turn position and the right-turn position, to the contact-neutral position by a pushing operation at the rotation neutral position of the switch lever 23.

Figure 8:
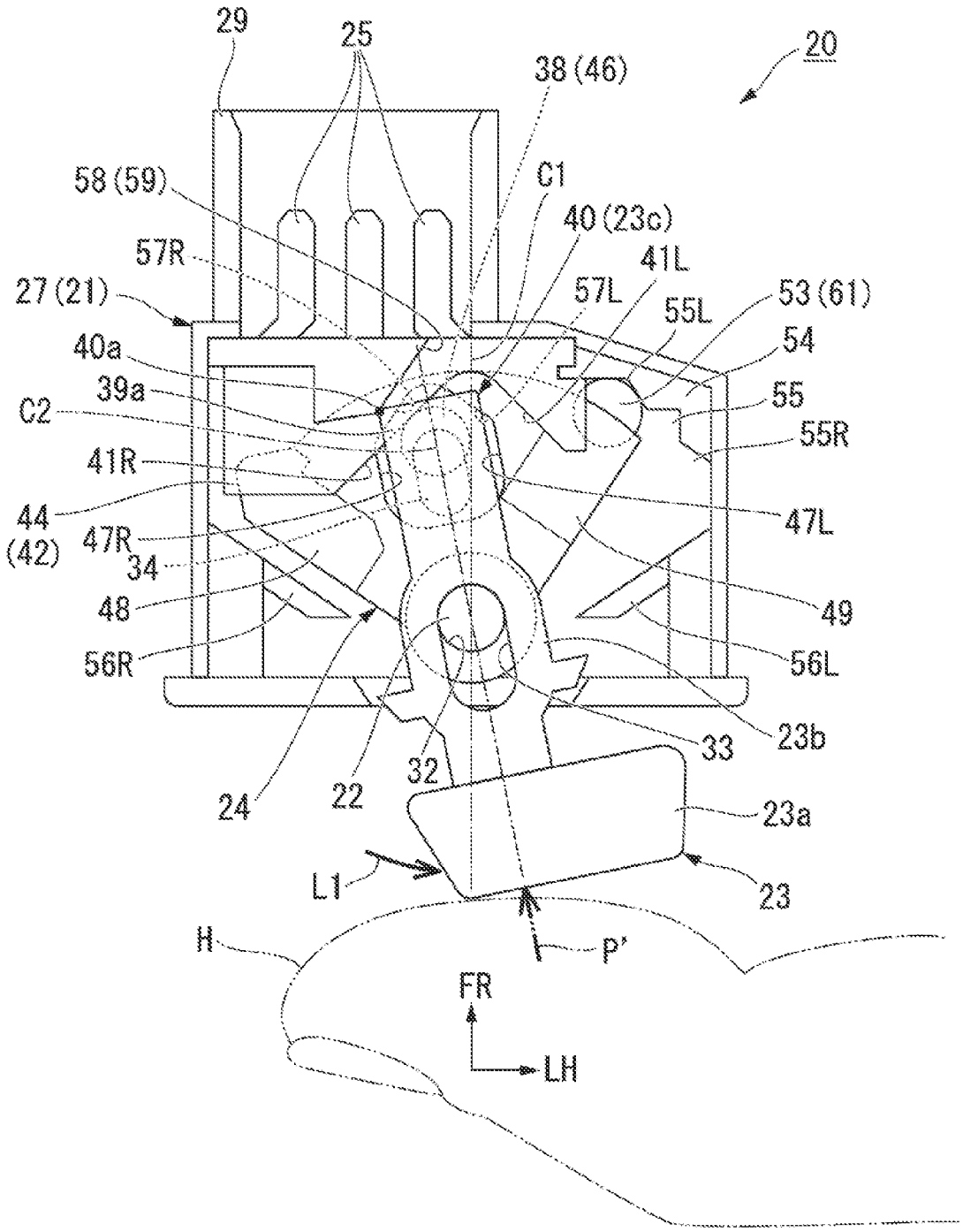
FIG. 8 is a plan view which corresponds to FIG. 3 and in which a rider tilts a switch lever from FIG. 5 to perform a cancel operation.

In order to cancel the blinker, an operation for pushing the switch lever 23 is performed, for example, in a state in which the operation portion 23*a* is pulled to the left hand's finger H side, that is, a state in which the switch lever 23 is tilted to any one of the left and right from the rotation neutral position as shown in FIG. 8. At this time, when the switch lever 23 is pushed in a state in which the switch lever 23 is rotated in the same direction as the rotation direction of the holder 24, the engaging protrusion 34 enters the valley between the left and right slopes 57L and 57R without coming into contact with the left and right slopes 57L and 57R of the cam hole 35 and a cancel operation becomes invalid. For this reason, the holder 24 does not return to the contact-neutral position.

FIG. 8 shows a state in which the switch lever 23 tilted to the left-turn position is to be pushed relative to the holder 24, which is present at the left-turn position, along an axis C2 inclined with respect to the center line C1 parallel to the front-rear direction. A direction of an arrow P' in FIG. 8 indicates a pushing direction when the switch lever 23 is pushed forward along the axis C2 in the state of FIG. 8.

When the left and right slopes 41L and 41R are steeply-inclined or a biasing force of the steel ball 38 is increased so that the switch lever 23 is not pushed in a state in which the switch lever 23 is tilted from the rotation neutral position, the operability of the switch lever 23 is greatly changed.

In this embodiment, a guide plate portion 59, which forms a second slope 58, is integrally formed stepwise on the lower surface (or the upper surface) of a right portion of the horizontal plate portion 44 of the guide member 42 to reliably perform a cancel operation caused by the push of the switch lever 23 after the good operability of the switch lever 23 is maintained.

For example, the guide plate portion 59 copes with a situation in which the switch lever 23 is pushed in a state in which the operation portion 23*a* of the switch lever 23 is pulled to the left hand's finger H side (a situation of FIG. 8), and is formed on the direction of the switch lever 23, which is indicated by the arrow P', at this time (at the right portion of the guide member 42). The second slope 58, which is inclined so that a portion, which is closer to the front side, of the guide plate portion 59 is positioned closer to the middle of the switch case 21, is formed on the direction of the switch lever 23, which is indicated by the arrow P', in a state in which the operation portion 23*a* is pulled to the left hand's finger H side.

The second slope 58 and the guide plate portion 59 are provided so as not to come into contact with the switch lever 23 during the rotational operation of the switch lever 23 and a pushing operation at the rotation neutral position and so as to come into contact with the switch lever 23 during only the pushing operation in the direction of the arrow P' in a state in which the switch lever 23 is tilted from the rotation neutral position in a direction of an arrow L1. Since the second slope 58 guides only the push of the switch lever 23 without affecting the rotational operation of the switch lever 23, as shown in FIG. 3, an inclination angle θ2 between the center line C1 (in other words, the pushing direction of the switch lever 23) and the second slope 58 seen in the direction of the rotating shaft is set to be smaller than an inclination angle θ1 between the center line C1 and the slopes 41L and 41R seen in a rotation axis direction so that the switch lever 23 is easily guided in the pushing direction.

Figure 9:
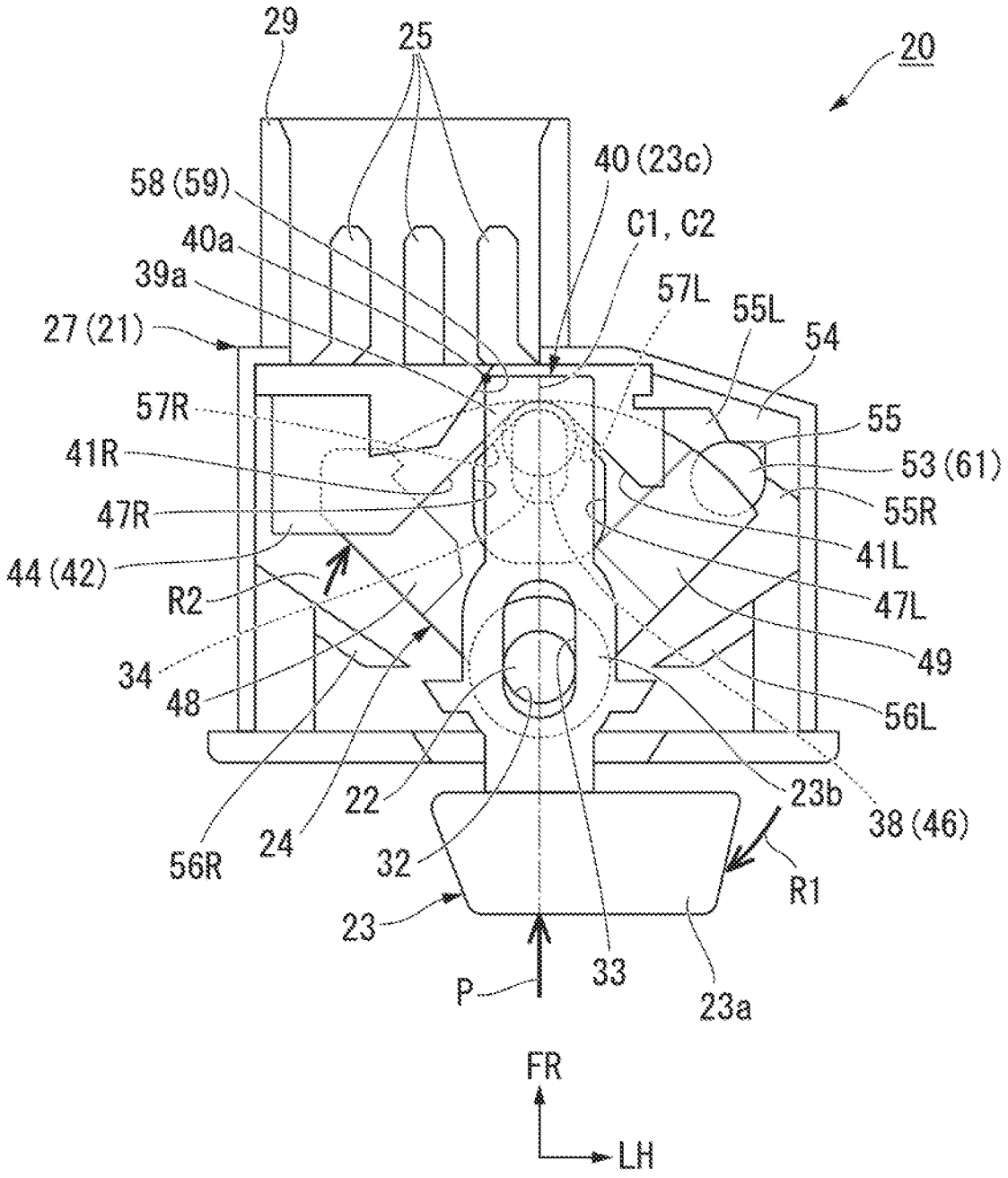
FIG. 9 is a plan view which corresponds to FIG. 3 and in which a rider has performed the cancel operation of FIG. 8.

When the switch lever 23 is pushed in the direction of the arrow P' in a state in which the operation portion 23*a* is pulled to the left hand's finger H side, a front corner portion 40*a* of the lower plate-like portion 39*a*, which moves forward along the lower surface of the horizontal plate portion 44, comes into sliding contact with the second slope 58 and rotates the switch lever 23 in the direction of the arrow R1, so that the switch lever 23 returns to the rotation neutral position as shown in FIG. 9. Accordingly, in the later half of the operation for pushing the switch lever 23, the switch lever 23 is pushed in the direction of the arrow P, the engaging protrusion 34 comes into contact with the left slope 57L of the cam hole 35, and the holder 24 is rotated in a direction of an arrow R2. Accordingly, the holder 24 can return to the contact-neutral position.

Since the second slope 58, which guides the switch lever 23 only in the pushing direction, is provided separately from the left and right slopes 41L and 41R affecting the operability of the switch lever 23 as described above, it is possible to prevent an operation failure that is caused by the oblique push of the switch lever 23 and to reliably perform an operation for cancelling the blinker.

In addition, the second slope 58, which guides the switch lever 23 in the pushing direction, is not limited to a flat surface, and may be, for example, a curved surface that is curved in the shape of an arc. In this embodiment, the guide plate portion 59, which functions when the operation portion 23*a* of the switch lever 23 is pulled to the left hand's finger H side (the left turn side) to perform a pushing operation, is merely provided at the right portion of the guide member 42. However, a guide plate portion, which functions when a pushing operation is performed while the operation portion 23*a* is pushed to the side opposite to the left hand's finger H (the right turn side), may be provided at a left portion of the guide member 42 and may be provided at both left and right portions of the guide member.

As described above, a switch according to the embodiment is the blinker switch 20 including: the switch case 21; the switch lever 23 that is supported by the switch case 21 so as to allow a rotational operation to one side and the other side and a pushing operation at the rotation neutral position between one side and the other side; the guide member 42 that is provided on the side opposite to the operation portion 23*a* of the switch lever 23 in the switch case 21 and forms the left and right slopes 41L and 41R disposed in a V shape; and the steel ball 38 that is held at the front end portion 23*c* of the switch lever 23 close to the guide member 42 and is biased to the left and right slopes 41L and 41R. The lever neutral position restoration mechanism 46, which includes the steel ball 38 and the guide member 42 and returns the switch lever 23 to the rotation neutral position by a force for pressing the steel ball 38 against the left and right slopes 41L and 41R, is formed in the blinker switch 20. The blinker switch 20 includes the guide plate portion 59 that is provided in the switch case 21, does not come into contact with the switch lever 23 during the rotational operation of the switch lever 23 and the pushing operation at the rotation neutral position, and comes into contact with the switch lever 23 during the pushing operation in a state in which the switch lever 23 is tilted from the rotation neutral position. The guide plate portion 59 forms a second slope 58 that is disposed so as to return the switch lever 23, which comes into contact with the second slope 58, to the rotation neutral position.

According to this structure, the second slope 58, which comes into contact with the switch lever 23 only when the switch lever 23 is pushed in a state in which the switch lever 23 is tilted from the rotation neutral position and guides the switch lever 23 to the rotation neutral position, is provided separately from the left and right slopes 41L and 41R of the guide member 42. Accordingly, it is possible to reliably perform a cancel operation without affecting a force, which is generated by the slopes 41L and 41R of the guide member 42 and returns the switch lever 23 to the rotation neutral position, and the like even when the switch lever 23 is obliquely pushed. That is, it is possible to reliably perform a cancel operation that is caused by the push of the switch lever 23 while maintaining the good operational feeling of the switch lever 23.

Since the second slope 58 of the guide plate portion 59 of the switch is provided so as to be offset from the left and right slopes 41L and 41R of the guide member 42 in the rotation axis direction of the switch lever 23 (the vertical direction), it is possible to simply install the second slope 58 of the guide plate portion 59 while avoiding the steel ball 38 of the switch lever 23 in the rotation axis direction.

The longitudinal intermediate portion 23*b* of the switch lever 23 of the switch is supported by the rotating shaft 22, and the holding portion 40, which holds the steel ball 38, is formed at the front end portion 23*c* of the switch lever 23 close to the guide member 42. Since the front corner portion 40*a* of the holding portion 40 comes into contact with the second slope 58 of the guide plate portion 59, the front corner portion 40*a* of the holding portion 40 present at a position distant from the rotation axis of the switch lever 23 comes into contact with the second slope 58 of the guide plate portion 59. Accordingly, it is possible to reasonably return the switch lever 23 to the rotation neutral position by a force that is generated when the switch lever 23 comes into contact with the second slope 58.

Since the guide member 42 of the switch is provided separately from the switch case 21, it is possible to ensure the same operability by changing only the guide member when the shape or the like of the switch lever 23 is changed. Accordingly, it is possible to easily change the switch lever 23.

Further, since the guide plate portion 59 is provided integrally with the guide member 42, it is possible to integrally change portions (the guide member 42 and the guide plate portion 59) corresponding to the change of the switch lever 23. Accordingly, it is possible to easily change the switch lever 23 and to suppress an increase in the number of components.

The switch includes the holder 24 that holds the movable contact 26 coming into contact with or being separated from the stationary contacts 25 provided in the switch case 21, is supported so as to be rotatable to one side and the other side together with the switch lever 23 from the contact-neutral position where the flow of current between the contacts is cut off in the switch case 21, and is rotated by the rotational operation of the switch lever 23. Since the holder 24 is disposed so as to be offset from the switch lever 23 to one side in the rotation axis direction of the switch lever 23 and the guide plate portion 59 is disposed so as to be offset from the slopes 41L and 41R of the guide member 42 to the other side in the rotation axis direction of the switch lever 23, the holder 24 and the guide plate portion 59 are disposed so as to be distributed to one side and the other side in the rotation axis direction of the switch lever 23. Accordingly, it is possible to increase a degree of freedom in the disposition of switch components by suppressing interference between the guide plate portion 59 and the holder 24.

In addition, the invention is not limited to the embodiment. For example, the invention is not limited to a blinker switch, and may be applied to switches of vehicle components, such as various lamp devices, and may be applied to switches of optional devices, such as an audio system and a car navigation system. Movable elements and biasing members therefor having the same functions as the steel balls 38 and 53 and the coil springs 37 and 52 may be used instead of the steel ball 38 and the coil spring 37 that are held by the switch lever 23 and the steel ball 53 and the coil spring 52 that are held by the holder 24.

The holder 24 holding a contact may not be provided, the switch case 21 may be provided with stationary contacts to which the switch lever 23 corresponds at the left-turn position, the right-turn position, and the pushing position from the rotation neutral position, and a movable contact provided at the tip portion of the switch lever 23 may selectively come into contact with or may be selectively separated from these stationary contacts. Accordingly, the switch may be adapted to detect the rotational operation of the switch lever 23 and a pushing operation at the rotation neutral position.

The invention may be applied to not only a motorcycle (including a motorbike and a scooter-type vehicle) but also a three-wheeler (which includes not only a vehicle with one front wheel and two rear wheels but also a vehicle with two front wheels and one rear wheel) or a four-wheeler.

Further, the structure of the embodiment is an example of the invention, and may be modified in various ways without departing from the scope of the invention.

REFERENCE SIGNS LIST

20: blinker switch (switch)
21: switch case
C1: center line (center line of case)
22: rotating shaft
23: switch lever
23*a*: operation portion
23*c*: front end portion (end portion)
25: stationary contact
26: movable contact
38: steel ball (movable element)
40: holding portion
40*a*: front corner portion (tip)
41L, 41R: left and right slopes (slopes)
θ1: inclination angle
42: guide member (first guide portion)
46: lever neutral position restoration mechanism
58: second slope
η2: inclination angle
59: guide plate portion (second guide portion)

The invention claimed is:

1. A switch comprising:

a switch case;

a switch lever that is supported by the switch case so as to allow a rotational operation and a pushing operation;

a first guide portion that is provided on a side opposite to an operation portion of the switch lever in the switch case and forms a V-shaped slope;

a movable element that is held at an end portion of the switch lever close to the first guide portion and is biased to the slope;

a lever neutral position restoration mechanism that includes the movable element and the first guide portion and returns the switch lever to a rotation neutral position by a force for pressing the movable element against the slope; and a second guide portion that is provided in the switch case, does not come into contact with the switch lever during the rotational operation of the switch lever and the pushing operation at the rotation neutral position, and comes into contact with the switch lever during the pushing operation in a state in which the switch lever is tilted from the rotation neutral position, wherein the second guide portion forms a second slope that is disposed so as to return the switch lever, which comes into contact with the second slope, to the rotation neutral position, and wherein during the pushing operation in the state in which the switch lever is tilted from the rotation neutral position, the switch lever comes into contact with the second slope of the second guide portion and is pushed while returning to the rotation neutral position.

2. The switch according to claim 1, wherein an inclination angle between the second slope and a center line of the switch case, which is parallel to a pushing direction of the switch lever at the rotation neutral position, is smaller than an inclination angle between the slope and the center line.

3. The switch according to claim 1, wherein the second slope of the second guide portion is provided so as to be offset from the slope of the first guide portion in a rotation axis direction of the switch lever.

4. The switch according to claim 1, wherein a longitudinal intermediate portion of the switch lever is supported by a rotating shaft, a holding portion, which holds the movable element, is provided at the end portion of the switch lever close to the first guide portion, and a tip of the holding portion comes into contact with the second slope of the second guide portion.

5. The switch according to claim 1, wherein the first guide portion is provided separately from the switch case, and the second guide portion is provided integrally with the first guide portion.

6. The switch according to claim 1, further comprising:

a holder that holds a movable contact coming into contact with or being separated from stationary contacts provided in the switch case, is supported so as to be rotatable together with the switch lever from a contact-neutral position where a flow of current between the contacts is cut off in the switch case, and is rotated by the rotational operation of the switch lever, wherein the holder is disposed so as to be offset from the switch lever to one side in a rotation axis direction of the switch lever and the second guide portion is disposed so as to be offset from the slope of the first guide portion to the other side in the rotation axis direction of the switch lever.

* * * * *